United States Patent [19]

Luebbers

[11] 4,036,145

[45] July 19, 1977

[54] PERCUSSION FUSE ASSEMBLY

[75] Inventor: Willi Luebbers, Trittau, Germany

[73] Assignee: Nico-Pyrotechnik Hanns-Juergen Diederichs KG., Trittau, Germany

[21] Appl. No.: 693,001

[22] Filed: June 4, 1976

[30] Foreign Application Priority Data

June 19, 1975 Germany ..... 2527339

[51] Int. Cl.[2] ..... F42C 1/04

[52] U.S. Cl. ..... 102/73 R; 102/78

[58] Field of Search ..... 102/76 R, 76 P, 73 R, 102/73 A, 78, 79, 70 R

[56] References Cited

U.S. PATENT DOCUMENTS

| | | | |
|---|---|---|---|
| 190,861 | 5/1877 | Hotchkiss | 102/73 R |
| 785,846 | 3/1905 | Wieser | 102/79 |
| 1,232,853 | 7/1917 | Schneider | 102/79 |
| 1,280,521 | 10/1918 | Moren | 102/78 |
| 1,861,521 | 6/1932 | Brandt | 102/79 |

FOREIGN PATENT DOCUMENTS

| | | | |
|---|---|---|---|
| 469,623 | 11/1950 | Canada | 102/73 R |

*Primary Examiner*—David H. Brown

[57] ABSTRACT

An improved construction for a percussion fuse interposed between a charge-carrying shell body and a shell head disposed forwardly of the shell body is described. An impact body, which carries the percussion cap of the fuse and which is normally maintained in its rearmost position to hold the cap away from a firing pin extending rearwardly from the shell head, is provided with an inwardly and rearwardly extending frustoconical recess in its front surface, such recess terminating at the front surface of the percussion cap. A conventional inertial sphere is normally disposed within the first recess during the acceleration phase of the shell flight, and is movable forwardly in an inertial manner toward the shell head during a subsequent deceleration of the shell. The firing pin in the shell cap is in turn formed from a forward cylindrical portion, which defines a sphere-receiving annular recess with the surrounding wall of the shell head, and a rear conical portion which conforms to the conical angle of the first recess in the impact member to define a sphere-clamping chamber therebetween when the shell is suddenly decelerated during the normal acceleration portion of its flight.

2 Claims, 4 Drawing Figures

PERCUSSION FUSE ASSEMBLY

BACKGROUND OF THE INVENTION

The invention relates to percussion fuses for munitions shells, and more particularly to percussion fuses assemblies interposed between a charge-containing shell body and a shell head disposed forwardly of the shell body. In conventional percussion fuse assemblies of this type, a firing pin extends rearwardly from a rear surface of the shell head, and the percussion cap which is ignitably cooperable with the firing pin is carried in an impact member that is slidably disposed in a fixed sleeve portion of the fuse assembly. In order to normally maintain the impact member in its rear-most position to prevent engagement of the firing pin and the percussion cap, a selectively dischargeable blocking sphere is carried in mating apertures in the wall of the impact body and the surrounding fixed sleeve.

A second, inertia-influenced sphere is normally disposed in a front recess of the impact member during the acceleration portion of the shell flight, and is thereafter movable inertially forwardly of the recess and into a receiving recess situated in the shell head. When such inertial sphere is in its forward position, the impact member is free to be propelled forwardly upon impact of the shell with the target, thereby causing the percussion cap to impact the primer and be detonated thereby.

In one proposed arrangement of this type, the sphere-receiving groove in the shell head is radially offset from the recess in the impact member, so that if the shell encounters an obstacle, such as camoflage, during the acceleration portion of its flight, the sudden forward movement of the impact member, and thereby of the inertial sphere disposed in its recess, will cause such sphere to be wedged between the wall of the recess and the radial step at the rearward end of the sphere-receiving recess in the shell member. As a consequence, the impact member is prevented from moving to its front-most position, and thereby prevents the premature contact of the percussion cap with the firing pin.

While this fail-safe feature is generally desirable, it can inhibit somewhat the normal inertial forward travel of the sphere from the recess in the impact member to the recess in the shell head, particularly when the shell exhibits a relatively large degree of rotation about its longitudinal axis. In particular, during such rotational movement, a force component is generated that opposes the inertial forward movement of the sphere, so that such sphere may not have sufficient forward velocity to move into the radially offset recess in the shell head. Thus, when the impact member is shot forwardly during contact with the target, the failure of the sphere to reach the rear surface of the radially displaced recess in the shell head will cause such sphere to be wedged between such step and the wall of the recess in the impact member, exactly as if the shell had hit an obstacle during the acceleration phase of its flight.

SUMMARY OF THE INVENTION

The present invention provides an improved fuse assembly of the general type discussed above, such improved assembly being adapted both (a) to assure seating of the inertial sphere in the recess of the shell head when the target is impacted irrespective of the degree of rotation of the shell about its axis, and (b) to assure fail-safe operation in preventing such detonation when the shell is subjected to a sudden deceleration force during the acceleration portion of its flight.

In an illustrative embodiment, the impact member is provided with a frusto-conical recess in its front surface, such recess extending inwardly and rearwardly toward the front surface of the percussion cap centrally carried in the impact member. Thus, during the acceleration portion of the flight, the inertial sphere will be disposed in contact with the internal wall of the frusto-conical recess.

The firing pin extending rearwardly from the shell head is formed in two sections, i.e., a front cylindrical section and a rear concial extension which extends rearwardly from the rear end of the front cylindrical section.

The annular recess defined in the shell head between the outer surface of the cylindrical section of the primer and the surrounding internal wall of the shell fuse is situated in axial alignment with the normal path of inertial forward movement of the sphere during the normal, uninhibited deceleration phase of the shell flight. Because of the absence of a radial offset of the recess in the shell head, the inertial forward movement of the sphere will carry the sphere into the shell head recess even during a relatively rapid rotation of the shell around its axis.

The conical angle of the rear portion of the firing pin is arranged to correspond to the conical angle of the taper in the impact member. Thus, by making the internal wall of the recess in the impact member larger than the tapered wall of the rear section of the firing pin, the premature forward movement of the impact section caused by sudden deceleration forces applied to the shell when an obstacle is encountered will serve merely to wedge, the inertial sphere between such mating conical walls, since during the relevant portion of the flight such sphere will be in contact with the wall of the recess in the impact member. Thus, fail-safe operation under such conditions will be guaranteed, notwithstanding the otherwise unimpeded path of movement of the inertial sphere into the annular recess of the shell head.

In order to maintain the impact member in its rear-most position after the firing of the shell from its cartridge, a puncturable close membrane may advantageously be disposed over the bore in the surrounding sleeve member, such membrane being in contact with the blocking sphere in order to normally confine such sphere in its blocking position after the cartridge is separated.

BRIEF DESCRIPTION OF THE DRAWING

The invention is further set forth in the following detailed description taken in conjunction with the appended drawing, in which.

DETAILED DESCRIPTION

Figure 1:
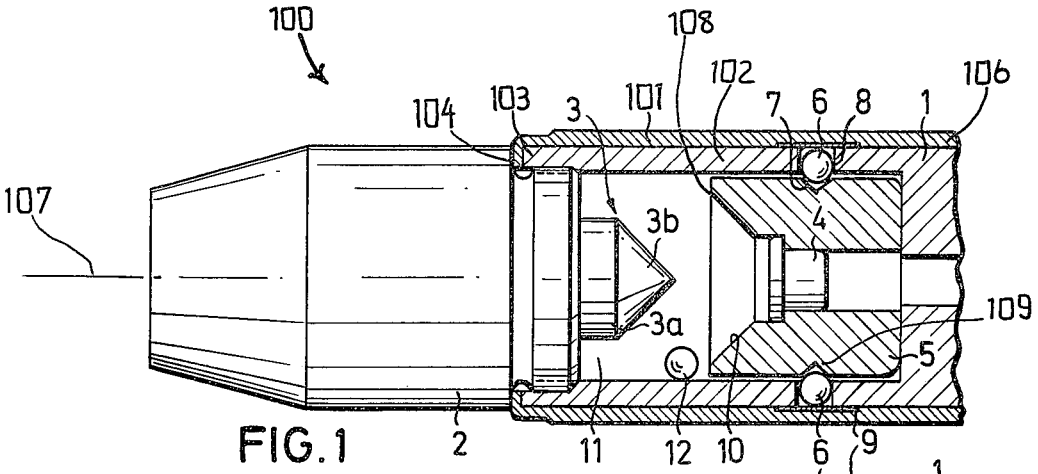
FIG. 1 is a longitudinal view, partially in section, of an explosive munitions shell containing an improved percussion fuse assembly in accordance with the invention, the shell being shown in its separable cartridge prior to firing.

Referring now to the drawing, FIG. 1 illustrates the front portion of an unfired, explosive munitions shell 100, illustratively a mortar shell, having an improved percussion fuse assembly 101 constructed in accordance with the invention. The shell 100 includes a main shell body (not shown) that contains a conventional explosive charge. The shell further includes a shell head 2 that is disposed forwardly of and in spaced relation to the main shell body.

A fuse body 1 of the fuse assembly 101 threadedly interconnects the front portion of the not-illustrated shell body with the rear portion of the shell head 2. The fuse body 1 has a forwardly projecting sleeve portion 102 whose front end 103 cooperates with a shoulder 104 on the shell head 2 to receive an inwardly crimped end of a shell cartridge 106 which extends along and overlies the outer periphery of the sleeve portion 102. The cartridge 106 is conventionally adapted to separate from the shell 100 when the latter is fired.

An impact member 5 is lockably received within the sleeve portion 102 for sliding movement along the shell axis (designated 107) between the rearmost rest position illustrated in FIG. 1 and a frontmost impact position described below.

A firing pin 3 is disposed coaxially in and extends rearwardly from the rear surface of the shell head 2. The firing pin 3 is disposed in aligned igniting relation with a percussion cap 4 carried by the impact member 5 rearwardly of a forward surface 108 of the member 5. Upon the engagement of the firing pin 3 by the percussion cap 4, an ignition ray shoots rearwardly from the cap 7 to detonate the charge in the shell body in a conventional manner.

The impact member 5, and thus the percussion cap 4, is normally maintained in spaced relation from the primer 3 by means of a locking arrangement that serves to constrain the impact member 5 in its rearward position. The blocking arrangement includes a pair of radial bores 8—8 extending through and disposed 180 ° apart around the periphery of the sleeve member 102. An annular, V-shaped groove 7 is disposed around the periphery of the impact member 5, and is aligned with the radial grooves 8 in the sleeve member 102 when the impact member 5 is in its rearmost position shown in FIG. 1. A pair of blocking spheres 6—6 are individually captured between the grooves 7 and the respective bores 8.

The fuse assembly 101 further comprises a second inertial sphere 12 which, during the initial or acceleration phase of the shell flight, is in engagement with a peripheral recess 10 in the front surface of the impact member 5, such recess having the construction described below. During deceleration of the shell 100 after firing, the sphere 12 travels slowly in the forward direction from its initial position in the recess 10 as indicated later in connection with FIGS. 2–4. The rear surface of the shell head 2 is provided with an annular recess 11 defined between a cylindrical front portion 3a of the primer assembly 3 and the surrounding sleeve portion 102 for receiving the sphere 13 at the end of the forward travel of the latter.

Overlying the outer periphery of each of the radial bores 8 in the sleeve member 102 is a puncturable, membranelike closure element 9 of the type described in copending, co-assigned application Serial No. 583,852 filed June 4, 1975 and entitled "PERCUSSION FUSE FOR AN EXPLOSIVE MUNITIONS SHELL". As described therein, the element 9 serves to retain the blocking sphere 6 in its illustrated seated position during the firing of the shell 100 and during the acceleration portion of its subsequent trajectory toward its target. This expedient prevents the interior wall of the barrel of the associated weapon from being longitudinally grooved by contact with the blocking sphere 6 after the cartridge 106 is separated from the shell 100 during firing, as illustrated best in FIG. 2. The element 9 is made sufficiently easily puncturable so that the radial outward propulsion of the blocking sphere 6 upon a slight forward camming movement of an inclined rear surface 109 of the groove 7 is effective to rupture the closure member 9 and permit the escape of the sphere 6.

The portion of the percussion fuse assembly 101 thusfar described operates as follows:

Prior to firing of the shell 100, the impact member 5, and thereby the percussion cap 4, is maintained in spaced relation to the firing pin 3 by the locking arrangememt including the sphere 6 and the mating holes 7 and 8. Upon firing, the cartridge 106 is separated from the shell 100, and during the acceleration phase of the shell trajectory, the sphere 6 is locked in position by means of the overlying closure member 9. During such acceleration phase, the inertial sphere 12 tends to maintain itself in contact with the recess 10 in the impact member 6 in the manner shown in FIG. 2.

Figure 2:
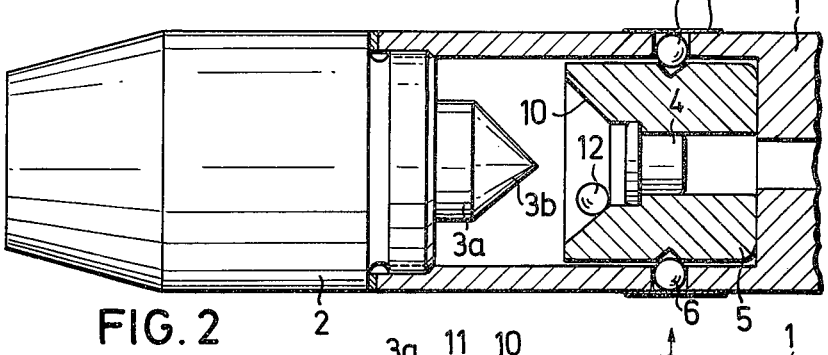
FIG. 2 is a longitudinal view, similar to FIG. 1, but illustrating the shell and fuse assembly during the first portion of its trajectory after being fired.
Figure 3:
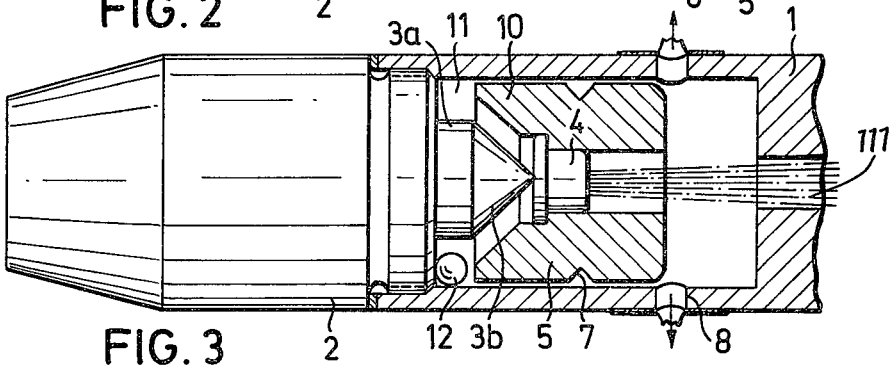
FIG. 3 is a longitudinal view of the shell and fuse assembly of FIGS. 1 and 2 upon impact with a desired target and consequent detonation of the charge within the shell.
Figure 4:
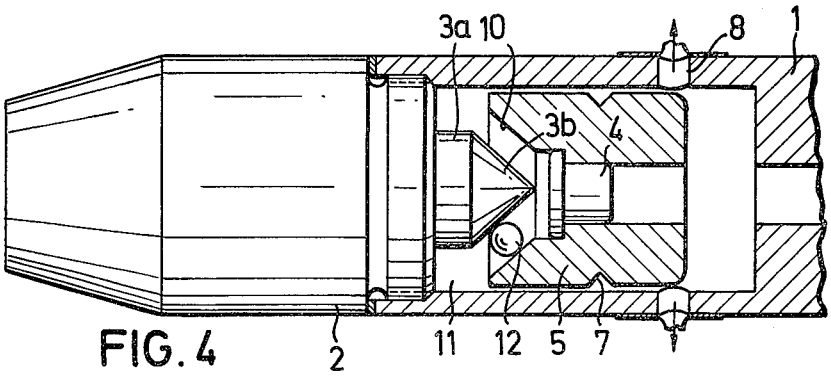
FIG. 4 is a longitudinal view of the shell of FIGS. 1-3, illustrating a fail-safe operation of the fuse assembly upon contact of the shell head with an obstacle during the first portion of the shell trajectory.

During a subsequent portion of the trajectory, when the air resistance starts to decelerate the shell head 2, the sphere 12 will tend to inertially move forward from the position illustrated in FIG. 2 and into the aligned recess 11 of the shell head 2 via the sloped portion 107. Upon the impact of the shell head 2 with the intended target, the sudden deceleration of the shell will cause the impact member 5 to start to move forward, whereby the camming surface 109 of the groove 7 will cause the blocking sphere 6 to puncture the closure member 9 as indicated in FIG. 3 and to escape from the fuse. At this point, the impact member 5 is free to travel forwardly until the percussion cap 4 contacts the firing pin 5, whereupon a resulting ignition ray 111 detonates the charge to explode the shell.

The aligned relation of the annular recess 11 with the normal path of forward movement of the inertial sphere 12 is advantageous in that it assures that the sphere 12 will enter the recess 11 irrespective of the degree of rotation of the shell 100 about its longitudinal axis 107. Such rotation, which in many cases represents instability caused by excessive manufacturing tolerances, sets up a force which opposes the normal forward inertial movement of the sphere 12 during deceleration of the shell. Notwithstanding the advantage provided by the aligned disposition of the recess 11, it is desirable to provide additional facilities for preventing the impact body 5, and thus the percussion cap 4, from contacting the firing 3 prematurely, i.e., during a sudden deceleration of the shell caused not by impact with the target, but by contact with an obstacle, such as a camoflage net, leaves or the like. Under ordinary circumstances, the imposition of such obstacle in the path of the shell trajectory during the first or acceleration portion of the flight will have a braking effect on the impact member which, as in the true target impact situation of FIG. 3, causes the inclined surface 109 of the impact member to move forwardly and to thereby propel the blocking sphere outwardly through the puncturable closure member 9.

In accordance with the invention, contact of the percussion fuse 4 on the firing pin 3 during such premature deceleration of the shell is inhibited by a suitable construction of the rear portion of the firing pin 3 and the recess 10 in the front surface 104 of the impact body 5. In particular, the recess 10 is formed with a frusto-conical wall that extends rearwardly and inwardly from the front surface 108 of the impact member 5 and toward the front surface of the recessed percussion cap 4.

The firing pin 3 is provided with a conical rear portion **3*b* which abuts the front surface of the cylindrical front portion 3*a* and which extends rearwardly and inwardly coaxial with the frusto-conical recess 10 in the impact member 5. The conical angle of the exterior wall of the primer portion 3*b* corresponds to the conical angle of the recess 10. In addition, the wall of the recess 10 is made larger than the exterior surface of the firing pin portion 3*b*, so that when the impact member 5 moves forwardly upon a deceleration of the shell during the acceleration portion of the flight when the inertial sphere 12 is in contact with the wall of the recess 10, such wall will clamp such sphere 12 tightly against the cooperating exterior wall of the conical firing pin portion 3*b*. This, in turn, will prevent the percussion cap 4 from moving far enough forward to contact the tip of the firing pin 3,** so that premature detonation of the shell will be avoided.

In the foregoing, an illustrative arrangement of the invention has been described. Many variations and modifications will now occur to those skilled in the art. It is accordingly desired that the scope of the appended claims not be limited to the specific disclosure herein contained.

What is claimed is:

1. In an explosive munitions shell disposed in a cartridge separable upon firing of the shell and having a charge-containing shell body and a shell head disposed forwardly of and in spaced relation to the shell body, an improved percussion fuse assembly which comprises, in combination, a fuse body interconnecting the shell body and the shell head, the fuse body having a fixed sleeve portion containing at least one radial bore therethrough, an impact member lockably supported for axial movement in the sleeve portion between a rearmost rest position and a frontmost impact position, the impact body having an annular groove disposed in the periphery thereof in radial alignment with the first bore of the sleeve member when the impact member is in its rearmost position, a first blocking sphere seatable in the aligned first bore and peripheral groove to normally prevent substantial forward motion of the impact member, the impact member having a first frusto-conical inwardly and rearwardly extending central recess in the front surface thereof and a percussion cap disposed adjacent the rear end of the first recess, a second sphere carried in the fuse body and disposed in the first recess of the impact member during an acceleration of the shell, the second sphere being movable inertially and forwardly from the first recess and along the inner wall of the sleeve portion during a deceleration of the shell, and a firing pin centrally disposed in and extending rearwardly from the rear surface of the shell head and engageable with the percussion cap when the impact member is in its frontmost position, the firing pin having a front cylindrical portion and a rear conical portion abutting the front portion and tapering inwardly in the rearward direction at a conical angle which corresponds to the conical angle of the first recess, the internal wall of the first recess being larger than the external wall of the rear portion of the firing pin for clamping the second sphere therebetween upon a deceleration of the shell while the second sphere is disposed within the first recess, the wall of the front cylindrical portion of the firing pin defining, with the wall of the sleeve portion, a second annular recess disposed in the normal path of inertial movement of the second sphere during a deceleration of the shell for receiving the second sphere.

2. A shell as defined in claim 1, further comprising a puncturable closure membrane disposed over each first bore of the sleeve portion in contact with the associated first sphere to normally confine the associated first sphere in its seated position after the cartridge is separated.

* * * * *